US007942103B2

(12) United States Patent
Fujita

(10) Patent No.: US 7,942,103 B2
(45) Date of Patent: May 17, 2011

(54) CLOTH PRESSING DEVICE OF SEWING MACHINE

(75) Inventor: Shuuji Fujita, Chofu (JP)

(73) Assignee: Juki Corporation, Chofu-shi, Tokyo (JP)

( * ) Notice: Subject to any disclaimer, the term of this patent is extended or adjusted under 35 U.S.C. 154(b) by 385 days.

(21) Appl. No.: 12/198,276

(22) Filed: Aug. 26, 2008

(65) Prior Publication Data

US 2009/0056607 A1 Mar. 5, 2009

(30) Foreign Application Priority Data

Aug. 27, 2007 (JP) ..... 2007-219984

(51) Int. Cl.
*D05B 29/02* (2006.01)
*D05B 29/00* (2006.01)

(52) U.S. Cl. ..... 112/237

(58) Field of Classification Search ..... 112/235–240
See application file for complete search history.

(56) References Cited

U.S. PATENT DOCUMENTS 2,157,372 A * 5/1939 Weis ..... 112/235
2,627,240 A * 2/1953 Johnson et al. ..... 112/235
3,044,428 A * 7/1962 Hale et al. ..... 112/235
3,511,198 A * 5/1970 Hacking ..... 112/235
3,623,441 A * 11/1971 Schoij et al. ..... 112/235
5,289,790 A * 3/1994 Tseng ..... 112/235
5,335,612 A * 8/1994 Cizek et al. ..... 112/235
5,718,182 A * 2/1998 Nakayama et al. ..... 112/235

FOREIGN PATENT DOCUMENTS

JP 2003-181174 7/2003

* cited by examiner

*Primary Examiner* — Ismael Izaguirre

(74) *Attorney, Agent, or Firm* — Drinker Biddle & Reath LLP

(57) ABSTRACT

A cloth pressing device of a sewing machine is provided. The cloth pressing device includes a presser bar, a presser foot rotatably coupled to a lower end portion of the presser bar, an elastic member having a base end portion which is supported by the presser bar and a tip end portion which is engageable with a tip side portion of the presser foot to downwardly bias the tip side portion of the presser foot, and an adjusting mechanism operable to move the tip end portion of the elastic member between a position at which the tip end portion of the elastic member engages with the tip side portion of the presser foot and another position at which the tip end portion of the elastic member does not engage with the tip side portion of the presser foot.

7 Claims, 6 Drawing Sheets

CLOTH PRESSING DEVICE OF SEWING MACHINE

CROSS-REFERENCE TO RELATED APPLICATION

The present application claims priority from Japanese Patent Application No. 2007-219984 filed on Aug. 27, 2007, the entire content of which is incorporated herein by reference.

FIELD OF INVENTION

The present invention relates to a cloth pressing device of a sewing machine.

DESCRIPTION OF RELATED ART

Related art cloth pressing devices include a presser bar, a holder which is fixed to a lower end portion of the presser bar, and a presser foot having an intermediate portion which is rotatably coupled to the holder. The presser bar is supported by a sewing machine frame so as to be movable in up and down directions, and is elastically biased downward.

In order to reliably press a cloth with a tip side portion of the presser foot, some related art cloth pressing devices further includes an elastic member which is provided on the holder to downwardly bias the tip side portion of the presser foot. In addition, an adjusting member is disposed on a rear side of a coupling portion, which couples the holder and the presser foot, to lift a tip end of the presser foot when needed.

More specifically, for example, when reducing a pressing force of the tip side portion of the presser foot in order to address an uneven feeding of upper and lower portions of the cloth, a lift lever is operated such that an inclined portion of the lift lever contacts an inclined portion of the holder so as to cause the presser foot to rotate on the coupling portion serving as a fulcrum, whereby the tip end of the presser foot is lifted to create a gap between the tip side portion of the presser foot and a throat plate (see, e.g., JP 2003-181174 A).

However, when a thick portion, e.g., a stepped portion, of the cloth is fed below the tip side portion of the presser foot into the gap described above, the tip end of the presser foot may further be lifted. In such a case, the pressing force of the tip side portion of the presser foot becomes higher so that a friction given to the cloth increases.

Therefore, in a case of sewing a stretchable cloth, such as a knitted textile, having a thick portion, an upper portion of the cloth is caught by the presser foot when the thick portion reaches a position below the tip end of the presser foot, while a lower portion of the cloth will be fed and stretched by a feed dog. As a result, there has been a problem that a quality of a sewn product is remarkably deteriorated, or a sewing machine becomes inoperable due to the cloth being stuck at the presser foot.

SUMMARY OF INVENTION

It is an object of the present invention to provide a cloth pressing device of a sewing machine in which a pressing force to be applied from a tip side portion of a presser foot to a workpiece can be adjusted in accordance with types of the workpiece.

According to an aspect of the present invention, a cloth pressing device of a sewing machine is provided. The cloth pressing device includes a presser bar which is supported by a sewing machine frame so as to be movable in up and down directions and is downwardly biased, a presser foot having an intermediate portion which is coupled to a lower end portion of the presser bar so as to be rotatable around a horizontal axis, an elastic member having a base end portion which is supported by the presser bar and a tip end portion which is engageable with a tip side portion of the presser foot to downwardly bias the tip side portion of the presser foot, and an adjusting mechanism operable to move the tip end portion of the elastic member between a position at which the tip end portion of the elastic member engages with the tip side portion of the presser foot and another position at which the tip end portion of the elastic member does not engage with the tip side portion of the presser foot.

According to another aspect of the present invention, a cloth pressing device of a sewing machine is provided. The cloth pressing device includes a presser bar which is supported by a sewing machine frame so as to be movable in up and down directions and is downwardly biased, a presser foot having an intermediate portion which is coupled to a lower end portion of the presser bar so as to be rotatable around a horizontal axis, an elastic member having a base end portion which is supported by the presser bar and a tip end portion which is engageable with a tip side portion of the presser foot to downwardly bias the tip side portion of the presser foot, a lifting member which is rotatably supported by the lower end portion of the presser bar and is engageable with an intermediate portion of the elastic member from below, and an operating member which is rotatably supported by the lower end portion of the presser bar. The operating member includes a cam portion which rotates the lifting member to move the tip end portion of the elastic member between a position at which the tip end portion of the elastic member engages with the tip side portion of the presser foot and another position at which the tip end portion of the elastic member does not engage with the tip side portion of the presser foot.

Other aspects and advantages of the invention will be apparent from the following description, the drawings and the claims.

DETAILED DESCRIPTION

Hereinafter, an exemplary embodiment of the present invention will be described in detail with reference to the drawings. The following exemplary embodiment does not limit the scope of the invention.

Figure 1:
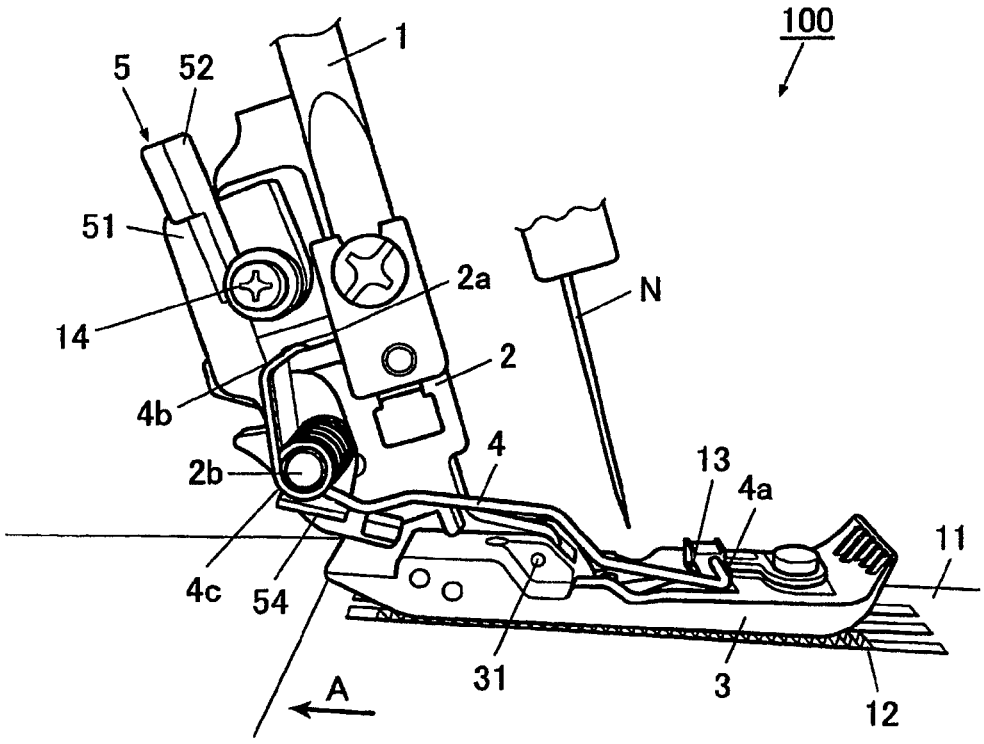
FIG. 1 is a perspective view of a cloth pressing device according to an exemplary embodiment the present invention, illustrating a state in which a presser foot is downwardly biased by a front presser spring.
Figure 2:
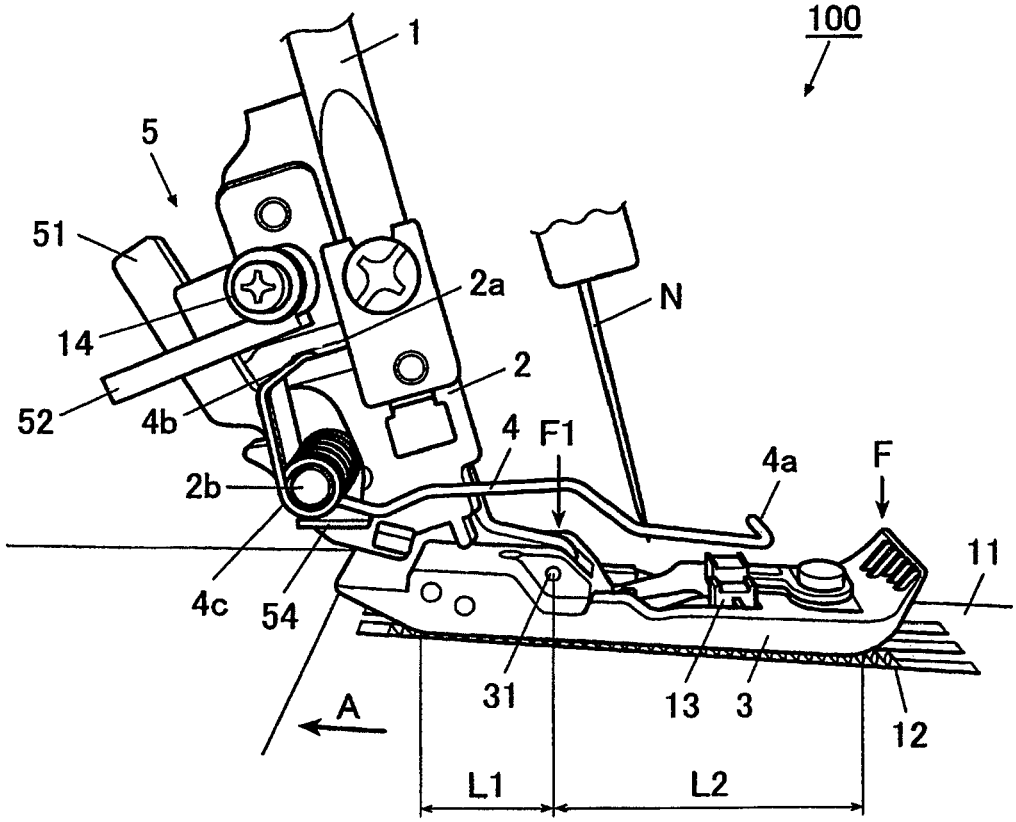
FIG. 2 is another perspective view of the cloth pressing device, illustrating a state in which the front presser spring is upwardly separated from the cloth presser.

As shown in FIGS. 1 and 2, a cloth pressing device 100 of a sewing machine (hereinafter, a pressing device 100) is provided near a needle N of the sewing machine. The pressing device 100 includes a presser bar 1, a holder 2 fixed to a tip end portion (i.e., a lower end portion) of the presser bar 1, a presser foot 3 rotatably coupled to the holder 2, a front presser spring 4 (an elastic member) having an base end portion 4*b* attached to the holder 2, and an adjusting mechanism 5 operable to adjust a position of a tip end portion 4*a* of the front presser spring 4. The presser bar 1 is supported by a sewing machine frame so as to be movable in up and down directions, and is downwardly biased by a coil spring (not shown). The presser foot 3 is disposed such that a longitudinal direction thereof extends along a cloth feeding direction A, and is coupled to the holder 2 at an intermediate portion in the longitudinal direction thereof via a horizontal support shaft 31 such that the presser foot is rotatable around the support shaft 31. The adjusting mechanism 5 is operable to move the tip end portion 4*a* of the front presser spring 4 between a position at which the tip end portion 4*a* of the front presser spring 4 downwardly biases a tip side portion of the presser foot 3 and another position at which the tip end portion 4*a* of the front presser spring 4 does not bias the presser foot 3.

The holder 2 is fixedly fastened to the lower end portion of the presser bar 1 by, for example, a screw. The holder 2 and the presser bar 1 may be regarded as an integral body, and may be formed in a one-piece structure.

The presser foot 3 has a flat bottom surface, and presses a cloth from above during a sewing operation so as to prevent a slippage of the cloth. A feed dog 12 is disposed below the presser foot 2 and is configured to project out from a throat plate 11 which supports the cloth from below, whereby the presser foot 2 and the feed dog 12 holds the cloth therebetween and feeds the cloth in the cloth feeding direction A. Although the presser foot 3 is coupled to the holder 2 at the intermediate portion thereof as described above, and the holder 2 is arranged to be inclined toward a base side portion of the presser foot 3. That is, the holder 2 is attached to the presser bar 1 such that a pressing force from the presser bar 1 primarily acts on the base side portion of the presser foot 3. A tip end portion of the presser foot 3 is upwardly bent so that a stepped portion of the cloth does not directly hit a tip end of the presser foot 3 when feeding the cloth.

The front presser spring 4 is configured as a wire spring, and is arranged such that the tip end portion 4*a* extends toward the tip side portion of the presser foot 3 so as to be able to engage with a spring receiving base 13 on an upper surface of the tip side portion of the presser foot 3. The base end portion 4*b* of the front presser spring 4 is attached to the holder 2 by being inserted into a slot 2*a* of the holder 2.

The front presser spring 4 is arranged so as to be able to press the spring receiving base 13 from above with an elastic force thereof to downwardly bias the presser foot 3. Accordingly, the presser foot 3 can press the cloth with both the base side portion and the tip side portion thereof.

The front presser spring 4 has a coiled portion 4*c* between the tip end portion 4*a* and the base end portion 4*b*, and a fulcrum shaft portion 2*b* of the holder 2 is inserted through the coiled portion 4*c* so that the tip end portion 4*a* is rotatable around the coiled portion 4*c*.

The base end portion 4*b* of the front presser spring 4 may be directly supported on the lower end portion of the presser bar 1.

The adjusting mechanism 5 includes a lifting link 51 (a lifting member) formed with a lifting portion 54 to upwardly move the tip end portion 4*a* of the front presser spring 4, and an operating member 52 operable to cause the lifting link 51 to move the front presser spring 4.

More specifically, when switching the position of the tip end portion 4*a* of the front presser spring 4 from the position at which the tip end portion 4*a* of the front presser spring 4 downwardly biases the presser foot 3, i.e., at which the tip end portion 4*a* of the front presser spring 4 engages the tip side portion of the presser foot 3, to the other position at which the tip end portion 4*a* of the front presser spring 4 does not bias the presser foot 3, the lifting portion 54 is caused to upwardly push a portion of the front presser spring 4 between the coil portion 4*c* and the tip end portion 4*a*.

Figure 3:
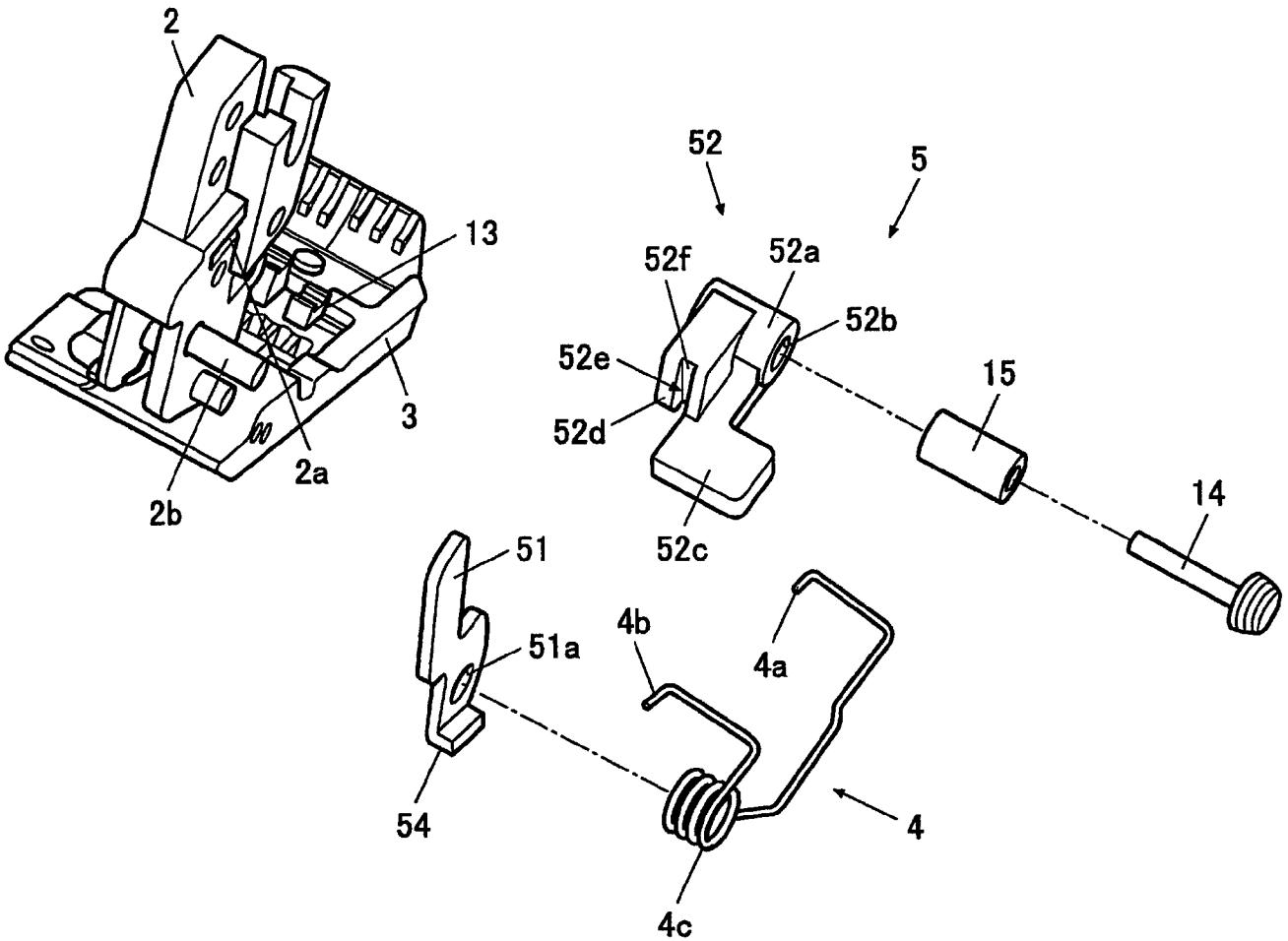
FIG. 3 is an exploded perspective view illustrating an adjusting mechanism of the cloth pressing device.
Figure 4:
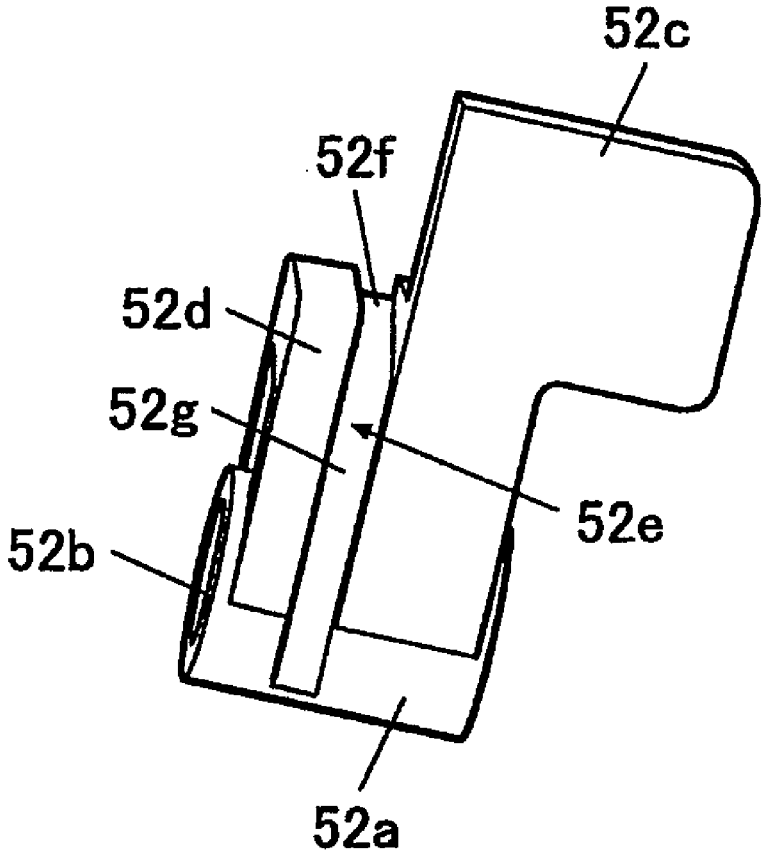
FIG. 4 is a perspective view of an operating member of the cloth pressing device.

As shown in FIG. 3, the lifting link 51 is a plate shaped member, and is formed with an insertion hole 51*a* on a lower side portion thereof. The fulcrum shaft portion 2*b* is inserted into the insertion hole 51*a* so that the lifting link 51 is rotatable around the fulcrum shaft portion 2*b*. The lifting portion 54 is formed on a lower end portion of the lifting link 51 to upwardly push the front presser spring 4 from below. When assembling, the fulcrum shaft portion 2*b* of the holder 2 is firstly inserted into the insertion hole 51*a* of the lifting link 51, and is then inserted into the coil portion 4*c* of the front presser spring 4.

As shown in FIGS. 1 to 3, the operating member 52 has a shaft portion 52*a* through which an insertion hole 52*b* is formed, and a set screw 14 is inserted into the insertion hole 52 via a cylindrical shaft member 15, which is also inserted into the insertion hole 52, and is fixed to an upper side portion of the holder 2, whereby the operating member 52 is rotatably attached with respect to the holder 2.

The operating member 52 also has an operating portion 52*c* radially extending from the shaft portion 52*a*, and a wall portion 52*d* extending alongside the operating portion 52*c*. The operating portion 52*c* is formed in a plate shape, and is arranged so as to be manually operable on a downstream side, in the cloth feeding direction A, of a coupling portion between the presser bar 1 and the holder 2 to switch the position of the tip end portion 4*a* of the front presser spring 4.

A groove is formed between the operating portion 52*c* and the wall portion 52*d*, and a cam portion 52*e*, which is brought into contact with the lifting link 51, is formed along a bottom surface of the groove. The cam portion 52*e* includes a first cam portion 52*f*, which is brought into contact with the lifting link 51 when the front presser spring 4 is upwardly retracted so as not to bias the presser foot 3 downward, and a second cam portion 52*g*, which is brought into contact with the lifting link 51 when the front presser spring 4 biases the presser foot 3 downward. The first and second cam portions 52*f*, 52*g* are contiguously formed.

The first cam portion 52*f* and the second cam portion 52*g* are formed to extend primarily along intersecting directions respectively, and hold the lifting link 51 such that the lifting link 51 does not slide from one of the cam portions to the other unless the operating member 52 is rotated by a user. The first cam portion 52*f* is formed to be farther from a center axis of the shaft portion 52*a*, around which the operating member 52 rotates, than the second cam portion 52*g*.

Because the cam portion 52*e* is formed inside the groove between the operating portion 52*c* and the wall portion 52*d*, the lifting link 51 is held so as not to be displaced from the cam portion 52*e* toward a side of the operating portion 52*c* or the wall portion 52*d*. Namely, a holding structure according to the exemplary embodiment includes the operating portion 52*c*, the wall portion 52*d*, and the cam portions 52*e*, 52*g*.

Next, operations of the pressing device 100 will be described.

When sewing a cloth such as a denim fabric for example, a sewing operation is carried out under normal conditions according to which a pressing force is applied from the front presser spring 4 to the tip side portion of the presser foot 3. More specifically, the tip end portion 4*a* of the front presser spring 4 is brought into contact with the spring receiving base 13 of the presser foot 3, and applies a downward moment load against the tip side portion of the presser foot 3.

Figure 5:
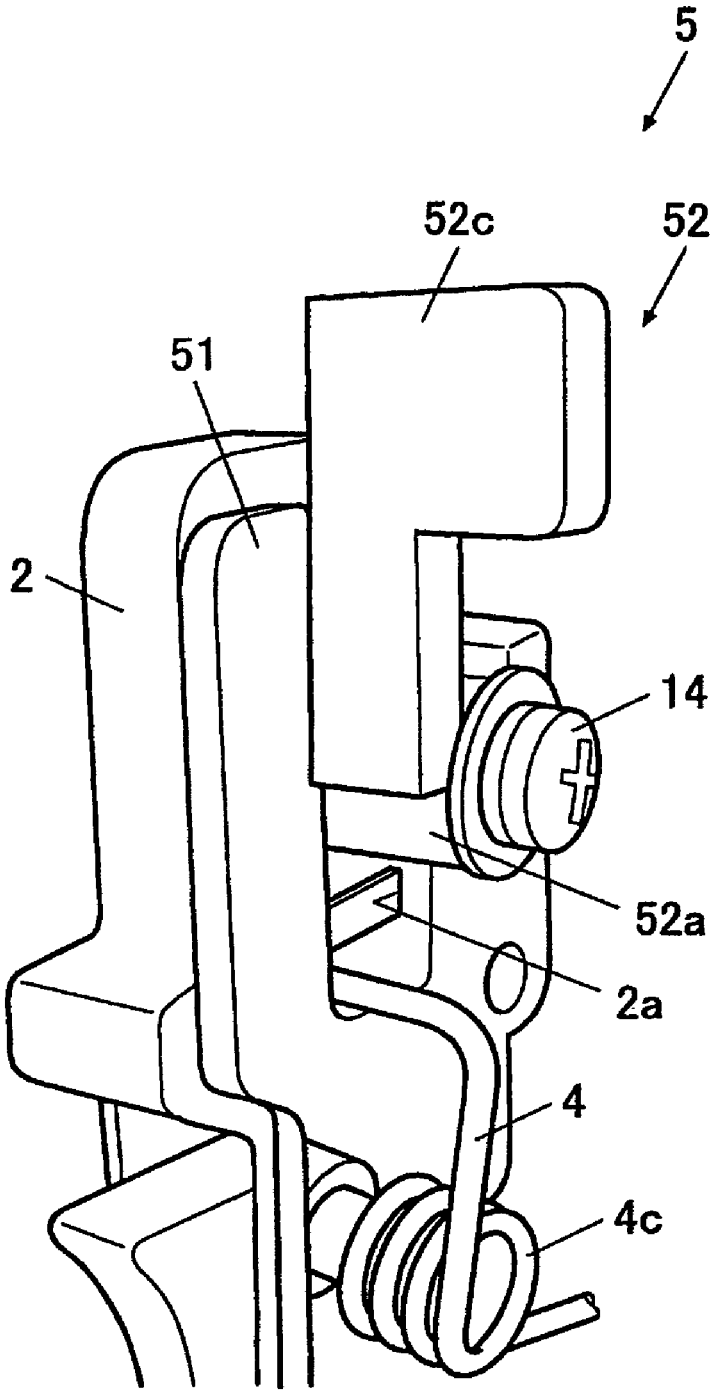
FIG. 5 is a perspective view of the adjusting mechanism, illustrating a state corresponding to FIG. 1.

In such a case, as shown in FIGS. 1 and 5, the operating portion 52*c* of the operating member 52 is positioned such that a tip end thereof is oriented upward, and a side edge portion of the lifting link 51 is brought into contact with the second cam portion 52*g*.

Figure 6:
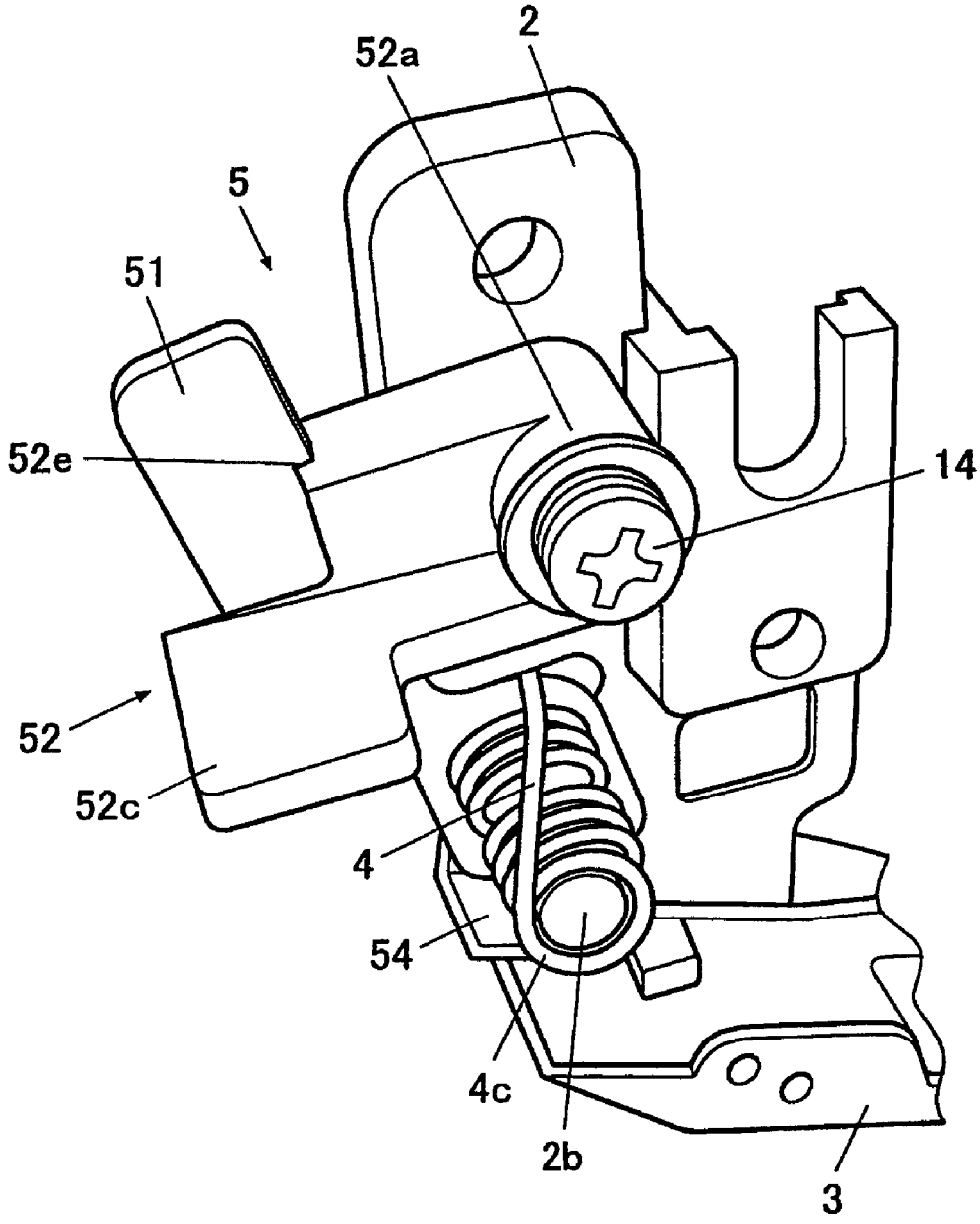
FIG. 6 is another perspective view of the adjusting mechanism, illustrating a state corresponding to FIG. 2.

When sewing a cloth such as a medium-thick knitted fabric for example, the operating portion 52*c* of the operating member 52 is rotated toward the cloth feeding direction A as shown in FIGS. 2 and 6.

When turning the operating portion 52*c* down toward the cloth feeding direction A, firstly the operating member 52 rotates around the shaft member 15 such that the second cam portion 52*g* gradually separates from the lifting link 51. Then, by a further rotation of the operating member 52, the second cam portion 52*g* completely separates from the lifting link 51, and the lifting link 51 comes into contact with a boundary portion between the first cam portion 52*f* and the second cam portion 52*g*. When the operating member 52 is further rotated, the lifting link 51 finally comes into contact with the first cam portion 52*f*.

In accordance with the turning movement of the lifting link 51 toward the cloth feeding direction A, the lifting link 51 rotates around the fulcrum shaft portion 2*b* so that the lifting portion 54 pushes up the portion of the front presser spring 4 between the tip end portion 4*a* and the coiled portion 4*c*, whereby the tip end portion 4*a* of the front presser spring 4 separates from the spring receiving base 13 of the presser foot 3 and moves upward. Accordingly, the tip side portion of the presser foot 3 is released from being downwardly biased by the front presser spring 4, and a cloth pressing force at the tip end of the presser foot 3 is reduced.

More specifically, as shown in FIG. 2, the pressing force F at the tip end of the presser foot 3 becomes:

$$F=F1\cdot L1/(L1+L2)$$

wherein F1 denotes a vertical load applied from the presser bar 1 to a hinge portion 31 (the support shaft), L1 is a horizontal distance from the hinge portion 31 to a rear end of a cloth pressing portion of the bottom surface of the presser foot 3, and L2 is a horizontal distance from the hinge portion 31 to a front end of the cloth pressing portion of the bottom surface of the presser foot 3.

That is, the force F required for a stepped portion of the medium-thick knitted fabric to lift up the tip end of the presser foot 3 is reduced, so that the stepped portion is prevented from being stuck.

Because the cam portion 52*e* is formed such that the boundary portion between the first cam portion 52*f* and the second cam portion 52*g* is bent, when the operating member 52 is downwardly turned so that the front presser spring 4 is brought into a state in which the tip end portion 4*a* does not bias the presser foot 3, the operating member 52 cannot return to the original position. That is, the elastic force of the front presser spring 4 is not sufficient to cause the lifting link 51 to shift the contacting portion thereof from the second cam portion 52*f* to the first cam portion 52*f* through the bent boundary portion. Therefore, it is possible to maintain the state in which the front presser spring 4 is separated from the spring receiving base 13 of the presser foot 3 at a constant height.

According to the pressing device 100 described above, when the pressing force is applied from the presser bar 1 to the holder 2, this pressing force also acts on the front presser spring 4 attached to the holder 2 so that the tip end portion 4*a* of the front presser spring 4 biases the tip end side of the presser foot 3 downward. Accordingly, a cloth can be pressed with the tip side portion of the presser foot 3 in addition to the base side portion of the presser foot 3.

When the user desired to reduce the pressing force of the tip side portion of the presser foot 3, e.g., when sewing a medium-thick knitted fabric, the user can operate the adjusting mechanism 5 to switch the position of the tip end portion 4*a* of the front presser spring 4 to the position at which the tip end portion 4*a* of the front presser spring 4 does not bias the tip side portion of the presser foot 3 downward. That is, in accordance with types of cloth to be sewn, the pressing force from the tip side portion of the presser foot 3 can be adjusted by switching the position of the tip end portion 4*a* of the front presser spring 4 with the adjusting mechanism 5.

Further, because the position of the tip end portion 4*a* of the front presser spring 4 is maintained, the user does not need to continuously press the operating member 52 against the biasing force of the front presser spring 4. Therefore, once the position of the tip end portion 4*a* of the front presser spring 4 is set, the user can perform operations with both hands. Consequently, it is possible to improve efficiency and accuracy of the sewing work.

Further, because the operating portion 52*c* is disposed near the coupling portion between the presser bar 1 and the holder 2, more specifically, on the downstream side, in the cloth feeding direction A, of the coupling portion the presser bar 1 and the holder 2, the user's hand can be prevented from being in contact with the cloth or the peripheral parts of the sewing machine when manually operating the operating portion 52*c* to switch the position of the tip end portion 4*a* of the front presser spring 4. Therefore, the operability when switching the position of the tip end portion 4*a* of the front presser spring 4 is improved.

Further, because the front presser spring 4 is pushed up by the lifting portion 54, the lifting of the tip end portion 4*a* of the front presser spring 4 can be implemented with a simple structure.

While description has been made in connection with an exemplary embodiment of the present invention, those skilled in the art will understand that various changes and modification may be made therein without departing from the present invention. For example, while the cam portion 52*e* has a two-stage construction including the first cam portion 52*f* and the second cam portion 52*g* in the exemplary embodiment described above, the portion between the first and second cam portions 52*f*, 52*g* may be divided into multiple continuous stages so that the operating member 52 is rotated in accordance with multiple stages. In such a case, the tip end portion 4*a* of the presser spring 4 can be set to a plurality of positions having different height, whereby the pressing force of the front presser spring 4 becomes more precisely adjustable in accordance with a thickness of the cloth.

Further, while description has been made in a case in which the front presser spring 4 is moved in accordance with types of workpiece to be sewn, the tip end portion 4*a* of the front presser spring 4 may be moved up just to reduce a feeding friction with respect to the workpiece.

What is claimed is:

1. A cloth pressing device of a sewing machine, the cloth pressing device comprising:

a presser bar which is supported by a sewing machine frame so as to be movable in up and down directions, and is downwardly biased;

a presser foot comprising an intermediate portion which is coupled to a lower end portion of the presser bar so as to be rotatable around a horizontal axis;

an elastic member comprising a base end portion which is supported by the presser bar and a tip end portion which is engageable with a tip side portion of the presser foot to downwardly bias the tip side portion of the presser foot; and an adjusting mechanism operable to move the tip end portion of the elastic member between a position at which the tip end portion of the elastic member engages with the tip side portion of the presser foot and another position at which the tip end portion of the elastic member does not engage with the tip side portion of the presser foot, wherein the adjusting mechanism comprises a lifting portion which contacts the elastic member to lift the tip end portion of the elastic member when switching the position of the elastic member from the position at which the tip end of the elastic member engages with the tip side portion of the presser foot to the other position at which the tip end portion of the elastic member does not engage with the tip side portion of the presser foot.

2. A cloth pressing device of a sewing machine, the cloth pressing device comprising:

a presser bar which is supported by a sewing machine frame so as to be movable in up and down directions, and is downwardly biased;

a presser foot comprising an intermediate portion which is coupled to a lower end portion of the presser bar so as to be rotatable around a horizontal axis;

an elastic member comprising a base end portion which is supported by the presser bar and a tip end portion which is engageable with a tip side portion of the presser foot to downwardly bias the tip side portion of the presser foot; and an adjusting mechanism operable to move the tip end portion of the elastic member between a position at which the tip end portion of the elastic member engages with the tip side portion of the presser foot and another position at which the tip end portion of the elastic member does not engage with the tip side portion of the presser foot, wherein the adjusting mechanism comprises a holding structure which holds the tip end portion of the elastic member at the position at which the tip end portion of the elastic member does not engage with the tip side portion of the presser foot, and wherein the adjusting mechanism further comprises a lifting portion which contacts the elastic member to lift the tip end portion of the elastic member when switching the position of the elastic member from the position at which the tip end of the elastic member engages with the tip side portion of the presser foot to the other position at which the tip end portion of the elastic member does not engage with the tip side portion of the presser foot.

3. A cloth pressing device of a sewing machine, the cloth pressing device comprising:

a presser bar which is supported by a sewing machine frame so as to be movable in up and down directions, and is downwardly biased;

a presser foot comprising an intermediate portion which is coupled to a lower end portion of the presser bar so as to be rotatable around a horizontal axis;

an elastic member comprising a base end portion which is supported by the presser bar and a tip end portion which is engageable with a tip side portion of the presser foot to downwardly bias the tip side portion of the presser foot; and an adjusting mechanism operable to move the tip end portion of the elastic member between a position at which the tip end portion of the elastic member engages with the tip side portion of the presser foot and another position at which the tip end portion of the elastic member does not engage with the tip side portion of the presser foot, wherein the adjusting mechanism comprises a holding structure which holds the tip end portion of the elastic member at the position at which the tip end portion of the elastic member does not engage with the tip side portion of the presser foot, wherein the holding structure comprises an operating portion which is operable to switch the position of the tip end portion of the elastic member, wherein the operating member is disposed on a downstream side, in a cloth feeding direction, of a coupling portion between the presser bar and the presser foot, and wherein the adjusting mechanism further comprises a lifting portion which contacts the elastic member to lift the tip end portion of the elastic member when switching the position of the elastic member from the position at which the tip end of the elastic member engages with the tip side portion of the presser foot to the other position at which the tip end portion of the elastic member does not engage with the tip side portion of the presser foot.

4. A cloth pressing device of a sewing machine, the cloth pressing device comprising:

a presser bar which is supported by a sewing machine frame so as to be movable in up and down directions, and is downwardly biased;

a presser foot comprising an intermediate portion which is coupled to a lower end portion of the presser bar so as to be rotatable around a horizontal axis;

an elastic member comprising a base end portion which is supported by the presser bar and a tip end portion which is engageable with a tip side portion of the presser foot to downwardly bias the tip side portion of the presser foot;

a lifting member which is rotatably supported by the lower end portion of the presser bar, and is engageable with an intermediate portion of the elastic member from below; and an operating member which is rotatably supported by the lower end portion of the presser bar, the operating member comprising a cam portion which rotates the lifting member to move the tip end portion of the elastic member between a position at which the tip end portion of the elastic member engages with the tip side portion of the presser foot and another position at which the tip end portion of the elastic member does not engage with the tip side portion of the presser foot.

5. The cloth pressing device according to claim 4, wherein the operating member is formed with a groove inside which the cam portion is disposed, and the cam portion comprises a first cam portion which engages with the lifting member to position the tip end portion of the elastic member at the position at which the tip end portion of the elastic member engages with the tip side portion of the presser foot and a second cam portion which engages with the lifting member to position the elastic member at the other position at which the tip end portion of the elastic member does not engage with tip side portion of the presser foot.

6. The cloth pressing device according to claim 5, wherein the first cam portion and the second cam portion are continuously formed along lines which intersects each other.

7. The cloth pressing device according to claim 5, wherein the cam portion further includes at least one additional cam portion which is continuously formed between the first cam portion and the second cam portion.

* * * * *